US008631620B2

(12) United States Patent
Guinn et al.

(10) Patent No.: US 8,631,620 B2
(45) Date of Patent: Jan. 21, 2014

(54) ADVANCED BUILDING ENVELOPE DELIVERY SYSTEM AND METHOD

(75) Inventors: Richard A. Guinn, North Wales, PA (US); Keith D. Boyer, Moon Township, PA (US)

(73) Assignee: Centria, Moon Township, PA (US), pp ( * ) Notice: Subject to any disclaimer, the term of this patent is extended or adjusted under 35 U.S.C. 154(b) by 0 days.

(21) Appl. No.: 12/726,977

(22) Filed: Mar. 18, 2010

(65) Prior Publication Data

US 2010/0170173 A1 Jul. 8, 2010

Related U.S. Application Data

(63) Continuation-in-part of application No. 11/654,181, filed on Jan. 17, 2007, now Pat. No. 7,748,181.

(60) Provisional application No. 60/760,804, filed on Jan. 20, 2006.

(51) Int. Cl.
*E04B 2/00* (2006.01)

(52) U.S. Cl.
USPC ..... 52/478; 52/404.2; 52/404.4; 52/309.11; 52/506.05

(58) Field of Classification Search
USPC ..... 52/235, 408, 513, 378, 379, 592.1, 52/404.2, 404.4, 409, 506.05, 592, 511, 52/410, 309.11, 478, 794.1, 506.04, 479, 52/588.1
See application file for complete search history.

(56) References Cited

U.S. PATENT DOCUMENTS

| | | | | |
|---|---|---|---|---|
| 3,427,775 | A | 2/1969 | Bachrich | |
| 3,535,844 | A | 10/1970 | Glaros | |
| 3,667,180 | A * | 6/1972 | Tischuk | 52/309.2 |
| 3,777,430 | A * | 12/1973 | Tischuk | 52/309.9 |
| 3,797,190 | A | 3/1974 | Widdowson | |
| 4,021,990 | A | 5/1977 | Schwalberg | |
| 4,037,377 | A | 7/1977 | Howell et al. | |
| 4,100,710 | A | 7/1978 | Kowallik | |
| 4,110,948 | A | 9/1978 | Maier, Jr. | |
| 4,123,885 | A | 11/1978 | Scott | |
| 4,184,301 | A | 1/1980 | Anderson et al. | |
| 4,236,366 | A | 12/1980 | Rijnders | |
| 4,250,678 | A | 2/1981 | Skuran | |
| 4,292,781 | A | 10/1981 | Chalmers et al. | |
| 4,304,083 | A | 12/1981 | Anderson | |
| 4,575,981 | A * | 3/1986 | Porter | 52/309.9 |

(Continued)

OTHER PUBLICATIONS

Koreteck—Home page (1 page) dated Nov. 4, 2005.

(Continued)

*Primary Examiner* — Robert Canfield
*Assistant Examiner* — Babajide Demuren
(74) *Attorney, Agent, or Firm* — The Webb Law Firm

(57) ABSTRACT

A building wall system includes first and second barrier panels, and an exterior facade system. Each panel includes an inner sheet and an outer sheet with a foam core positioned between the inner and outer sheets. Each of the inner and outer sheets defines an inner surface and an outer surface, respectively. A joint is defined by the first and second barrier panels. The exterior facade is secured to the first and second barrier panels via a fastener extending through the outer and inner sheets of the first barrier panel and the inner sheet of the second barrier panel without penetrating the inner surfaces of the first and second barrier panels.

20 Claims, 11 Drawing Sheets

(56) References Cited

U.S. PATENT DOCUMENTS

| | | | | | |
|---|---|---|---|---|---|
| 4,596,102 | A | | 6/1986 | Catani et al. | |
| 4,610,120 | A | | 9/1986 | Canavesi et al. | |
| 4,685,263 | A | | 8/1987 | Ting | |
| 4,700,520 | A | * | 10/1987 | Ting | 52/478 |
| 4,738,070 | A | | 4/1988 | Abbott et al. | |
| 4,765,107 | A | | 8/1988 | Ting | |
| 4,936,078 | A | | 6/1990 | Porter | |
| 4,955,172 | A | | 9/1990 | Pierson | |
| 4,970,842 | A | | 11/1990 | Kappeler et al. | |
| 5,228,257 | A | * | 7/1993 | Bowersox et al. | 52/588.1 |
| 5,247,770 | A | * | 9/1993 | Ting | 52/309.9 |
| 5,347,781 | A | | 9/1994 | Hanlon | |
| 5,373,678 | A | * | 12/1994 | Hesser | 52/592.1 |
| 5,425,210 | A | | 6/1995 | Zafir | |
| 5,473,851 | A | | 12/1995 | Northrup, Jr. | |
| 5,509,242 | A | * | 4/1996 | Rechsteiner et al. | 52/270 |
| 5,598,673 | A | | 2/1997 | Atkins | |
| 5,749,282 | A | | 5/1998 | Brow et al. | |
| 5,816,008 | A | | 10/1998 | Hohmann | |
| 5,875,592 | A | | 3/1999 | Allman et al. | |
| 6,000,178 | A | | 12/1999 | Goodings | |
| 6,070,382 | A | | 6/2000 | Ettema | |
| 6,212,841 | B1 | | 4/2001 | Plume | |
| 6,253,511 | B1 | | 7/2001 | Boyer | |
| 6,427,408 | B1 | | 8/2002 | Krieger | |
| 6,586,085 | B1 | * | 7/2003 | Jella | 428/319.1 |
| 6,627,128 | B1 | | 9/2003 | Boyer | |
| 6,951,086 | B2 | | 10/2005 | Passeno | |
| 6,968,659 | B2 | | 11/2005 | Boyer | |
| 7,469,511 | B2 | * | 12/2008 | Wobber | 52/474 |
| 2004/0134143 | A1 | | 7/2004 | Boyer | |
| 2004/0216416 | A1 | | 11/2004 | Hohmann et al. | |
| 2005/0210800 | A1 | | 9/2005 | Wobber | |
| 2006/0272255 | A1 | | 12/2006 | Honda | |

OTHER PUBLICATIONS

Koreteck—Panelized Building System (22 pages) dated Nov. 4, 2005.

BASF—Walltite Insulating Air Barrier System (3 pages) dated Nov. 18, 2005.

BASF—Spray Applied Technologies (3 pages) dated Nov. 18, 2005.

* cited by examiner

ADVANCED BUILDING ENVELOPE DELIVERY SYSTEM AND METHOD

CROSS REFERENCE TO RELATED APPLICATIONS

This application is a continuation-in-part application claiming priority to U.S. patent application Ser. No. 11/654,181 entitled "Advanced Building Envelope Delivery System and Method," filed Jan. 17, 2007, which is incorporated herein by reference in its entirety, claiming priority to U.S. Provisional Application Ser. No. 60/760,804 entitled "Advanced Building Envelope Delivery System and Method", filed on Jan. 20, 2006.

BACKGROUND OF THE INVENTION

1. Field of the Invention

The present invention is directed toward a building envelope delivery system and method and, more particularly, toward a building envelope delivery system and method which integrates an optimized barrier wall with integrated structural subframing specifically optimized for a variety of exterior facade systems.

2. Description of Related Art

One of the most important concerns in building envelope methodology is the air and water barrier located behind the exterior skin of the building. Since the exterior panel typically is a vented element, it generally has marginal performance rating as an air barrier and may even permit wind driven rain through its joinery. Thus, the interface of the air barrier element with the wall system perimeter and penetration trim and corner transitions must be carefully detailed and inspected, as well as the system drainage details.

The successful design of a rainscreen system relies heavily on the performance and installation of an air and water barrier. A properly designed exterior element of a good rainscreen wall system is one that will protect the air and water barrier and prevent most, if not all, of the water from entering the wall cavity from the exterior, while allowing the wall cavity to vent and drain any moisture that does enter. Moisture control within the wall cavity is an important concern in an effort to mitigate the potential for mold growth.

Current building envelope methodology requires multi-component systems to be used to achieve the thermal and moisture protection for the building interior. Present systems use such multi-component wall systems to achieve the barrier wall protection required with rainscreen panel system design. FIG. 1 illustrates such a traditional multi-component wall construction, shown generally at 10.

As shown in FIG. 1, the wall construction 10 includes wall framing 12 which is connected to the building structure 13 via a structural connection, shown at 14. A barrier element 16 is attached to the outer surface of the wall framing 12. Building wrap 18 is typically provided about the barrier element 16, with building insulation 20 applied over the building wrap 18. The barrier element 16, building wrap 18 and building insulation 20 of the wall construction 10 achieve the air, water, vapor and thermal barrier required with traditional rainscreen panel system designs. However, a problem with such traditional multi-component wall constructions is that the connectors, or tie-ins, for exterior facade panel systems typically need to penetrate the barrier formed by the multiple components in order to provide structural support for the exterior panels. As shown in FIG. 1, the exterior facade panel connector 22 extends through the barrier formed by the insulation 20, building wrap 18 and barrier element 16, and connects to the wall framing 12 to provide structural support for the exterior facade panels 24. This is because neither the insulation 20, the building wrap 18 nor the barrier element 16 are designed to provide structural support. Thus, in order to attach the exterior facade panel system 24 to the building, the air, water, vapor and thermal barrier of the traditional multi-component wall construction 10 must be compromised.

Additionally, during construction, the multi-component wall construction 10 can typically require multiple trades to execute the work. One group will put up the wall framing 12. Then another group may attach the barrier element 16. Yet another group may attach the building wrap 18. And still another group may attach the building insulation 20. Use of multiple trades during construction has the potential of becoming a trade coordination issue that can not only delay construction, but can complicate the identification of installation errors, thus resulting in system failure.

SUMMARY OF THE INVENTION

A building wall system includes first and second barrier panels, and an exterior facade system. Each panel includes an inner sheet and an outer sheet with a foam core positioned between the inner and outer sheets. Each of the inner and outer sheets defines an inner surface and an outer surface, respectively. A joint is defined by the first and second barrier panels. The exterior facade is secured to the first and second barrier panels via a fastener extending through the outer and inner sheets of the first barrier panel and the inner sheet of the second barrier panel without penetrating the inner surfaces of the first and second barrier panels.

The inner sheets of the first and second barrier panels may each include an end portion with the end portions being positioned being positioned adjacent each other at the joint and the fastener extending through the inner sheets of the first and second barrier panels at a position adjacent to the end portions. The end portion of the inner sheet of the first barrier panel may define a female connector and the end portion of the inner sheet of the second barrier panel may define a male connector, where the female connector receives the male connector. The end portions may overlap in a direction that extends perpendicularly from the outer surfaces. Sealant may be positioned between the end portions of the inner sheets of the first and second barrier panels or positioned within the female connector. The end portions of the inner sheets of the first and second barrier panels and the female connector and the male connector may positioned between the inner and outer surfaces.

In one embodiment, the inner sheets of the first and second barrier panels each include an end portion with the end portions being positioned adjacent each other at the joint. Each of the end portions includes an overlapped section of the respective inner sheets and the fastener extends through the inner sheets of the first and second barrier panels at a position adjacent to the end portions.

DESCRIPTION OF THE PREFERRED EMBODIMENTS

Figure 2:
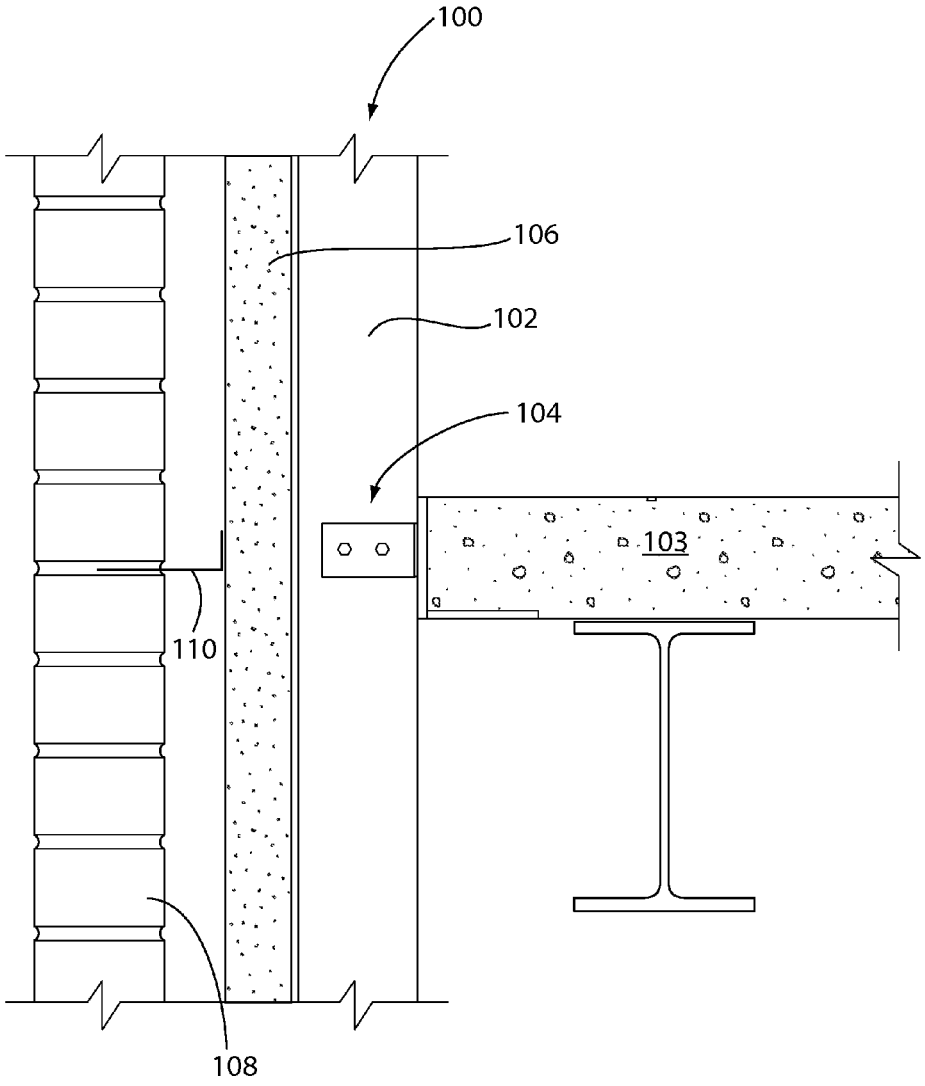
FIG. 2 illustrates a building envelope system in accordance with the present invention.

FIG. 2 illustrates a building envelope system, shown generally at 100, in accordance with the teachings of the present invention. The building envelope system 100 includes a metal stud support, or wall framing, 102 structurally connected to the building structure 103 via a structural connection at 104. A barrier panel 106 is attached to the outer face of the wall framing 102. The barrier panel 106 is a composite panel which provides an air, water, vapor and thermal barrier. An exterior panel system 108 is attached to the outer surface of the barrier panel 106 via an exterior panel connector piece 110.

Figure 1:
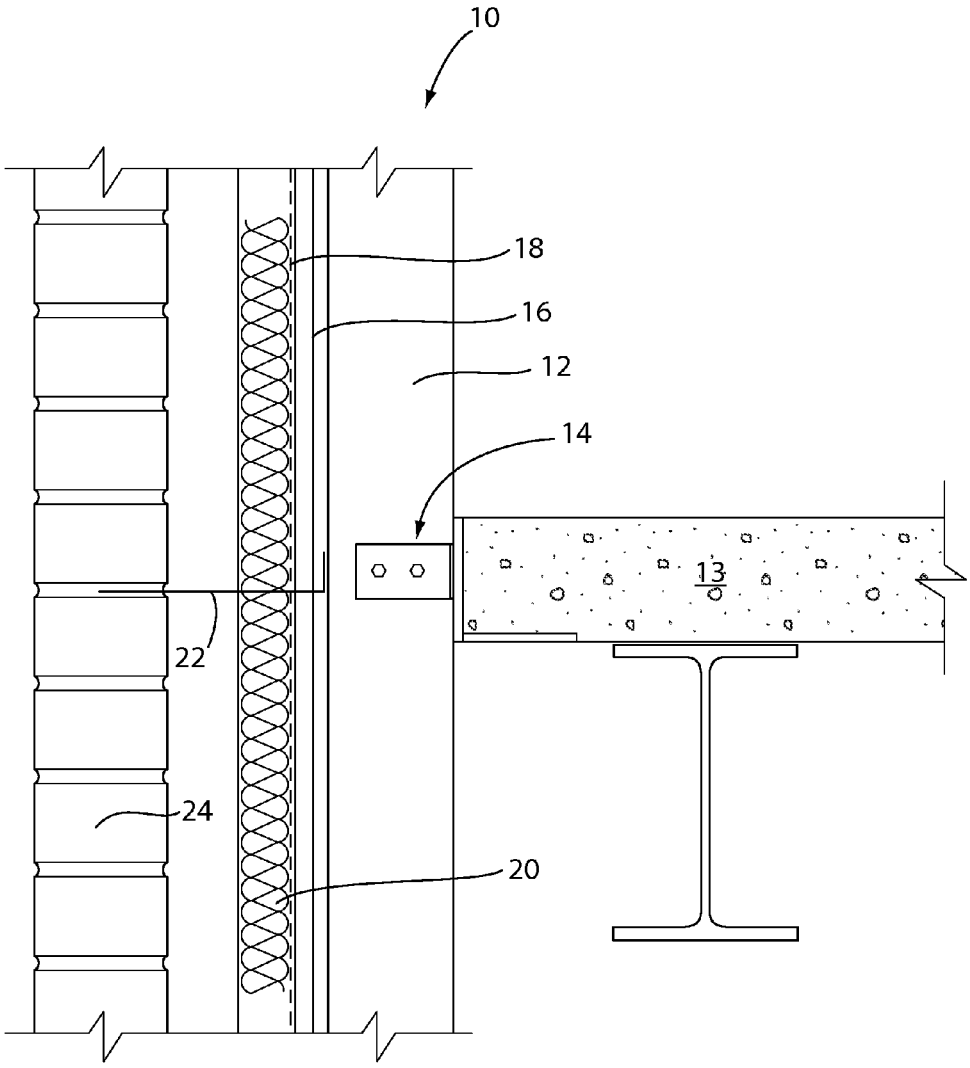
PRIOR ART FIG. 1
FIG. 1 illustrates a traditional, multi-component wall construction system.

Unlike in the prior art wall construction shown in FIG. 1, the exterior panel connector piece 110 does not extend through the barrier panel 106, and thus does not penetrate the air, water, vapor and thermal barrier provided by the barrier panel 106. In addition to providing an air, water, vapor and thermal barrier, the panels 106 provide structural support for the exterior facade system 108, which means that the exterior panel connector ties 110 can attach to the barrier panel 106, rather than extending back through the barrier formed by the panels 106 to the wall framing 102. Therefore, the present invention is able to achieve a continuous air, water, vapor and thermal barrier defined by the barrier panels 106.

Figure 3:
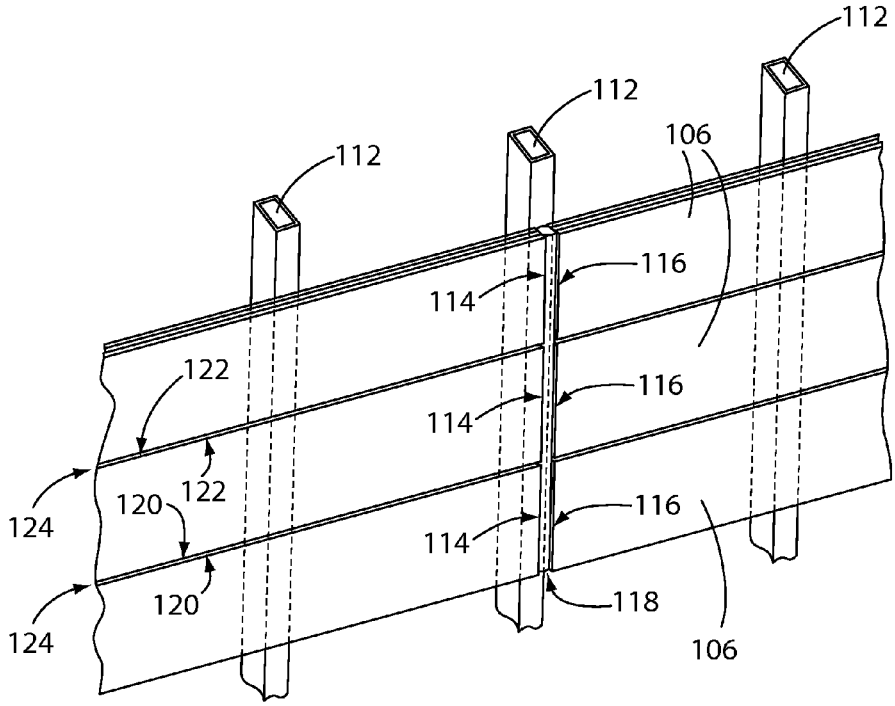
FIG. 3 is a perspective view of a building envelope system illustrating the connection of barrier panels in an exemplary horizontal joint configuration (in the embodiment where the system is rotated 90°, the illustrated horizontal joint becomes a vertical joint)

Referring to FIG. 3, the wall framing 102 typically includes vertical studs, or columns, 112 connected to the building structure (not shown in FIG. 3). The wall construction is assembled from individual barrier panels 106 having adjacent panel ends 114, 116 forming a vertical joint 118, and being connected along the upper and lower side edges 120, 122 to form a horizontal wall joint 124.

Figure 4:
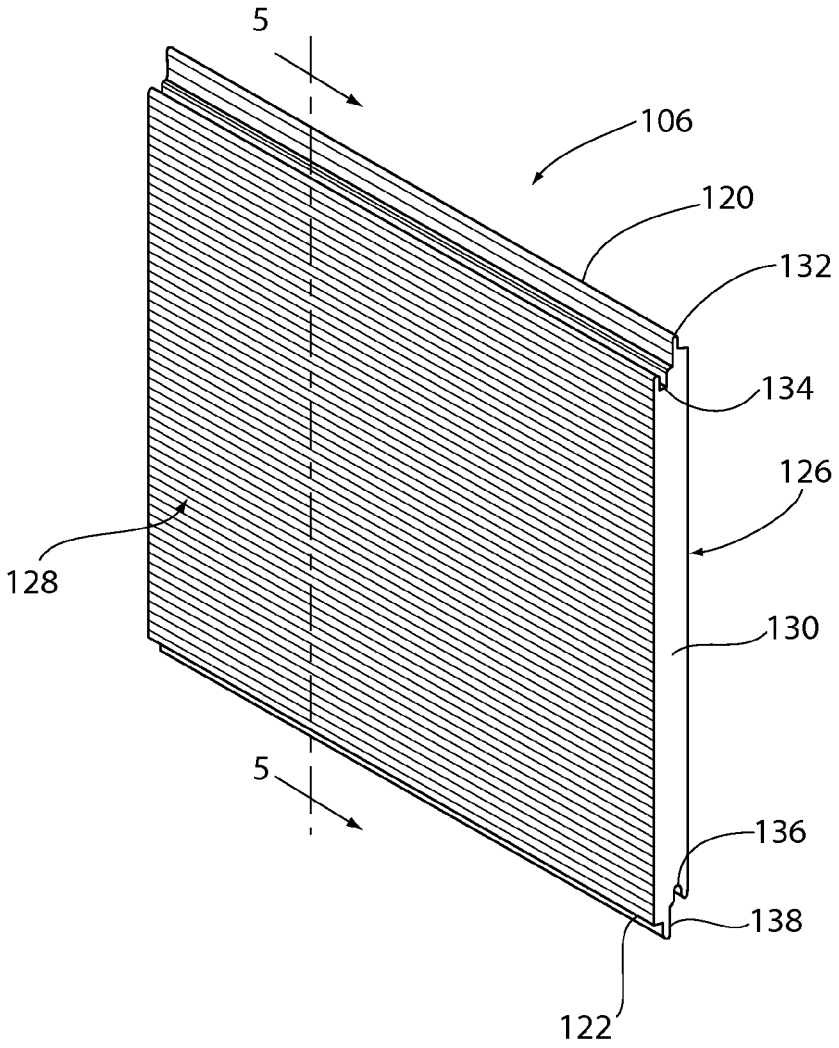
FIG. 4 is a perspective view illustrating a barrier panel in accordance with the present invention.
Figure 5:
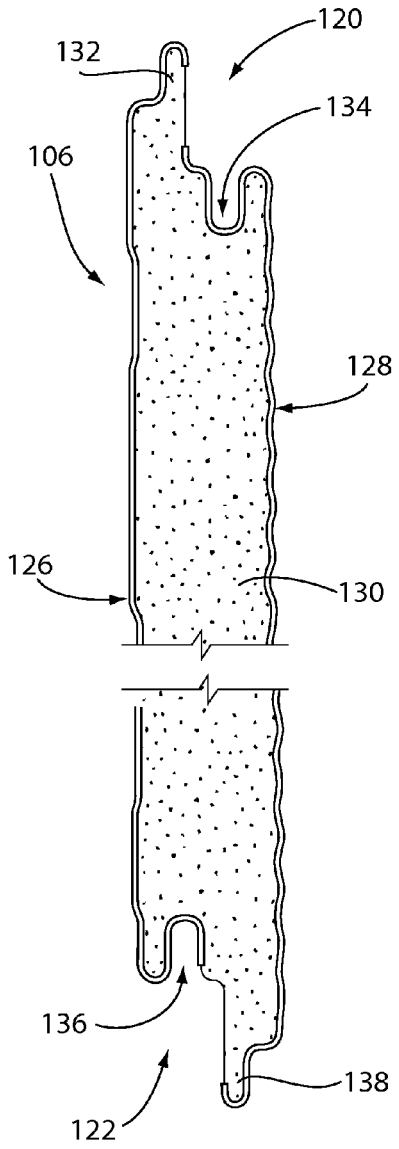
FIG. 5 is a cross-sectional view taken along line 5-5 in FIG. 4 illustrating a striated panel exterior surface.
Figure 6:
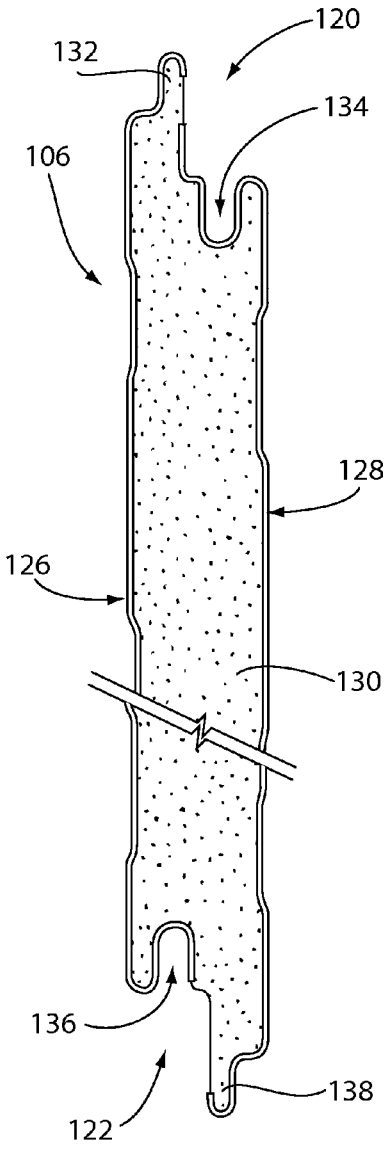
FIG. 6 is a cross-sectional view taken along line 5-5 in FIG. 4 illustrating a planked panel exterior surface.

Referring to FIGS. 4-7, the barrier panel 106 includes inner 126 and outer 128 facing sheets and a structural foam core 130 filling the interior space of the barrier panel 106 and adhesively connecting the facing sheets 126, 128 to provide a structural barrier panel 106. The structural foam core 130 may be provided between the inner 126 and outer 128 facing sheets by a variety of known means. In view of the bond provided between the structural foam core 130 and the facing sheets 126, 128, structural integrity and strength are greatly enhanced. While the outer facing sheet 128 is illustrated in FIG. 4-5 as being striated, other textures, including a smooth texture (flat skin), planked texture (see FIG. 6), etc., are contemplated for the outer facing sheet 128 without departing from the spirit and scope of the present invention.

At the upper edge 120 of the barrier panel 106, the inner 126 and outer 128 facing sheets connect and provide an inner male connector, or tongue, 132 and an outer female connector 134. At the lower edge 122 of the barrier panel 106, the inner 126 and outer 128 facing sheets connect and provide an inner female connector 136 and an outer male connector, or tongue, 138. The female connectors 134, 136 are adapted to receive the tongues 138, 132, respectively, of a subadjacent barrier panel 106, as shown in FIG. 7.

Figure 7:
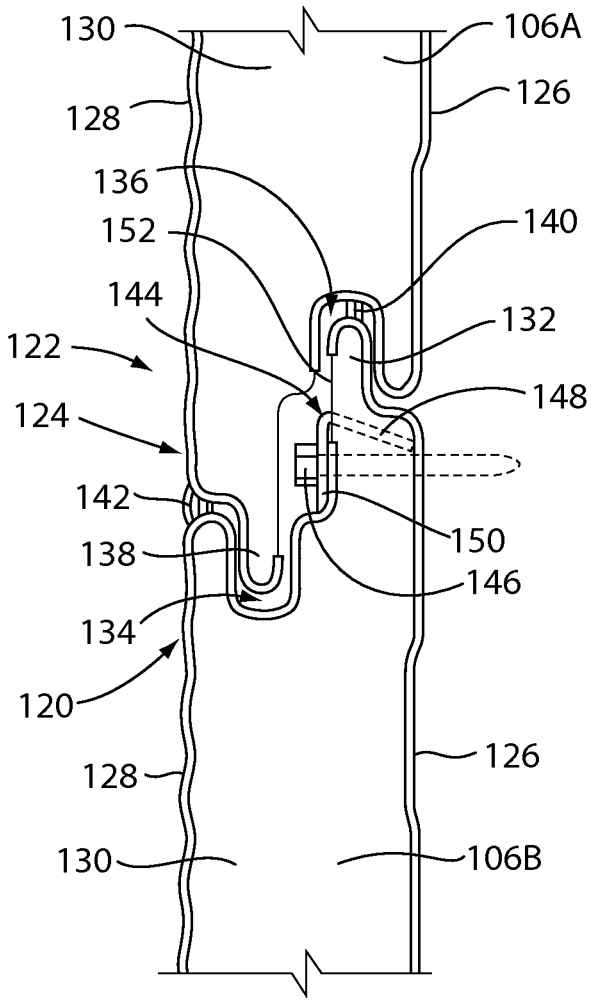
FIG. 7 illustrates an exemplary horizontal joint connection between top and bottom barrier panels, as well as connection of the barrier panels to the subframing (in the embodiment where the system is rotated 90°, the illustrated horizontal joint becomes a vertical joint)

As illustrated in FIG. 7, the inner female connector 136 typically receives a bead of sealant 140, such as a non-hardening butyl sealant. The bead of sealant 140 is adapted to be penetrated by the inner tongue 132 of a subadjacent barrier panel 106B to form an inner seal. A bead of sealant 142 is also provided at the horizontal joint 124 formed between subadjacent panels 106A, 106B to form an outer seal. While not shown in FIG. 7, the outer female connector 134 may also receive a bead of sealant adapted to be penetrated by the outer tongue 138 of a subadjacent panel 106A to further seal the horizontal joint 124.

FIG. 7 illustrates the horizontal joint 124 formed between upper and lower panels 106A, 106B. As shown in FIG. 7, a lower barrier panel 106B is secured at its upper edge 120 to the subframing 102 by a clip 144 and a fastener 146. The clip 144 includes a downturned central flange 148 penetrating the foam core 130, and a main flange portion 150 which overlies an upstanding side 152 of the upper edge 120 which forms part of the inner male connector 132. The fastener 146 extends through the main flange portion 150, the upstanding side 152, the foam core 130, the inner facing sheet 126, and into the wall framing 102. In this manner, both the inner 126 and outer 128 facing sheets of the panel 106B are secured to the wall framing 102. The upper panel 106A is maintained in position at its lower edge 122 via engagement of the outer male connector 138 with the outer female connector 134 of subadjacent panels 106A, 106B.

The foam core 130 is typically includes a polyurethane or poly-isocyanurate foam material having the following thermal properties: thickness from about 2.0 inches to about 2.75 inches; U (BTU/hour/sq.ft./° F.) from about 0.044 to about 0.069, and preferably from about 0.054 to about 0.069; and R (1/U) from about 14.4 to about 22.75, and preferably from about 14.4 to about 18.7. However, other types of foam core material, and combinations of materials, having thermal properties outside of the above ranges, as well as suitable structural, combustion and fire-resistant properties, may be utilized without departing from the spirit and scope of the present invention. For example, phenolic foam and mineral wool, and other similar materials and combinations thereof, may be utilized as the foam core material if desired.

The inner 126 and outer 128 facing sheets are typically made from G90 galvanized steel for structural strength purposes and to resist corrosion should moisture develop between the exterior facade system 108 and the barrier panels 106. However, other metallic materials, and combinations of materials, such as aluminum and other similar materials, are also contemplated for the inner 126 and outer 128 facing sheets. The combination of the foam core 130 surrounded by the inner 126 and outer 128 facing sheets (metal skins) allows the panels 106 to form the desired air, water, vapor and thermal barrier around the building.

The panels 106 are preferably 2 to 2¾ inches thick, 30 to 36 inches high, and 1 to 48 (more preferably 5 to 48) feet in length. However, other panel dimensions are also contemplated, and the dimensions herein recited are for illustrative purposes only and are not meant to limit the scope of the present invention. For example, the longer the lengths of the panels 106, the more continuous the barrier wall formed by the panels 106. The panel dimensions may be modified to suit particular applications without departing from the spirit and scope of the present invention.

Figure 8:
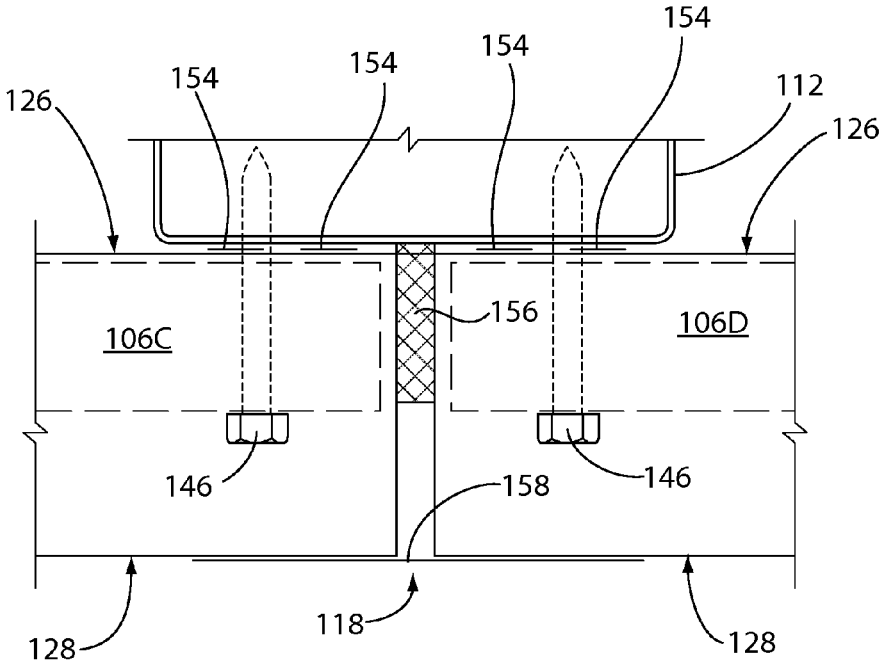
FIG. 8 is a top view of an exemplary vertical joint between side by side barrier panels (in the embodiment where the system is rotated 90°, the illustrated vertical joint becomes a horizontal joint)

FIG. 8 illustrates the vertical joint 118 where two panels 106C, 106D meet. As shown in FIG. 8, the vertical joint 118 is a butt joint. It is preferred that the vertical joints 118 be formed at the vertical supports 112 which make up the wall framing 102. Rows of protective sealant 154 are applied to the vertical supports 112 to provide a seal between the panels 106C, 106D and the vertical supports 112. A sealant 156, which may be in the form of a sealant tape, is provided in the vertical joint 118. A self-adhering butyl flashing tape 158 is provided on the exterior surfaces 128 of the panels 106C, 106D and covers the vertical joint 118 to prevent water and other moisture, as well as other debris, from entering the vertical joint 118.

The exterior facade 108 is typically secured to the barrier panels 106 at their horizontal joints 124 for strength purposes. This is the preferred method of attachment. However, the panels 106 provide structural support for the exterior facade system 108, such that the exterior facade system 108 may be attached to any portion of the panels 106.

Figure 9:
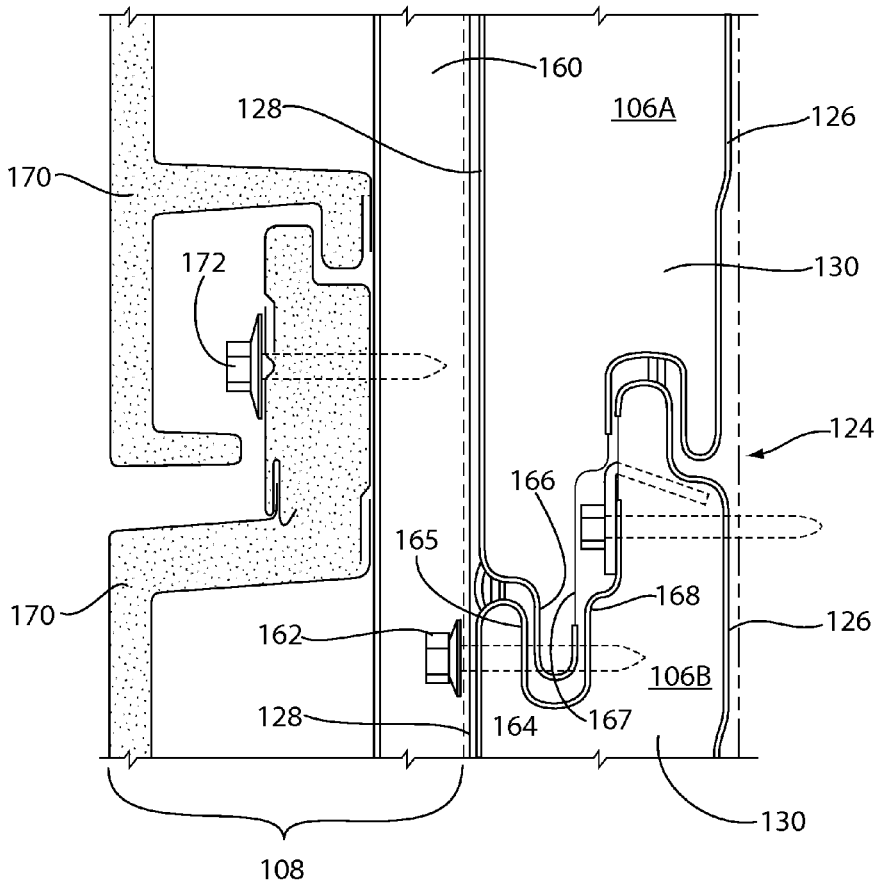
FIG. 9 illustrates connection of an exterior facade system to the barrier panels in accordance with the present invention.

As shown in FIG. 9, in a preferred form, the exterior facade system 108 is attached to the panels 106 at their horizontal joints 124. A vertical, or Z-shaped, subframe 160 is attached to the panels 106 by a fastener 162. The fastener 162 attaches the subframe 160 to the panels 106 at their horizontal joint 124. When attached at the horizontal joint 124, the fastener 162 extends through five layers of galvanized steel 164-168, and thus firmly secures the exterior facade system 108 to the panels 106. Attaching the exterior system 108 to the panels 106 in this manner increases the load capacity of the panels 106 several fold, since it is based on fastening into several layers of steel liners 164-168 at the horizontal joint 124. Since the fastener 162 extends into the foam core 130, but not though the interior sheet 126 of the panels 106, the air and vapor barrier defined by the interior sheets 126 of the panels 106 is not compromised. Exterior panels, shown generally at 170, are then attached to the subframe 160 via conventional fasteners 172.

Any type of exterior panel system may be attached to the subframe 160, and FIG. 9 illustrates one exemplary type of external panel system sold under the trademark FORMA-BOND®. As shown in FIG. 9, such exterior panels 170 will typically have an opening for ventilation should moisture enter between the exterior panels 170 and the barrier panels 106. In this manner, the air, water, vapor and thermal barrier formed by the panels 106 is still maintained, since no fastener extends all of the way through any of the panels 106. The subframe 160 and exterior panels 170 are securely attached to the panels 106, which provide support therefore.

Figure 10:
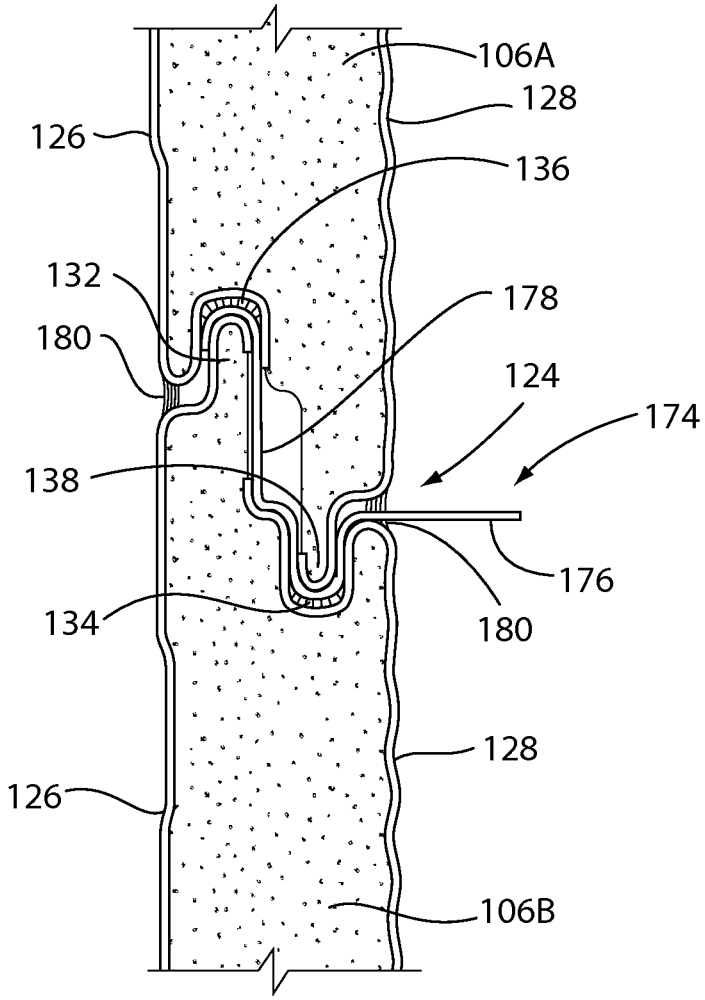
FIG. 10 illustrates connection of a brick tie-in at an exemplary horizontal joint between top and bottom barrier panels for attachment of a brick exterior facade to the barrier panels (in the embodiment where the system is rotated 90°, the illustrated horizontal joint becomes a vertical joint)

As shown in FIG. 10, if a brick exterior is desired, a brick tie, shown at 174, may be implemented at the horizontal joints 124 to support the brick exterior. As shown in FIG. 10, the brick tie 174 includes an outwardly extending portion 176 which attaches to the brick exterior (not shown). The brick tie 174 also includes an inwardly extending portion 178 which extends into, and generally conforms to, the horizontal joint 124, and thus secures the brick tie 174 to the panels 106A, 106B via engagement of the tongues 132, 138 with the female connectors 136, 134, respectively. Since bricks will typically rest on the ground, the brick tie 174 arrangement is designed for lateral support, rather than longitudinal support, of the bricks, which is typically not needed.

In addition to sealant being provided at the female connectors 134, 136, sealant 180 may also be provided at the horizontal joint 124 along both the inner 126 and outer 128 surfaces of the barrier panels 106 to further seal the horizontal joint 124.

Figure 11:
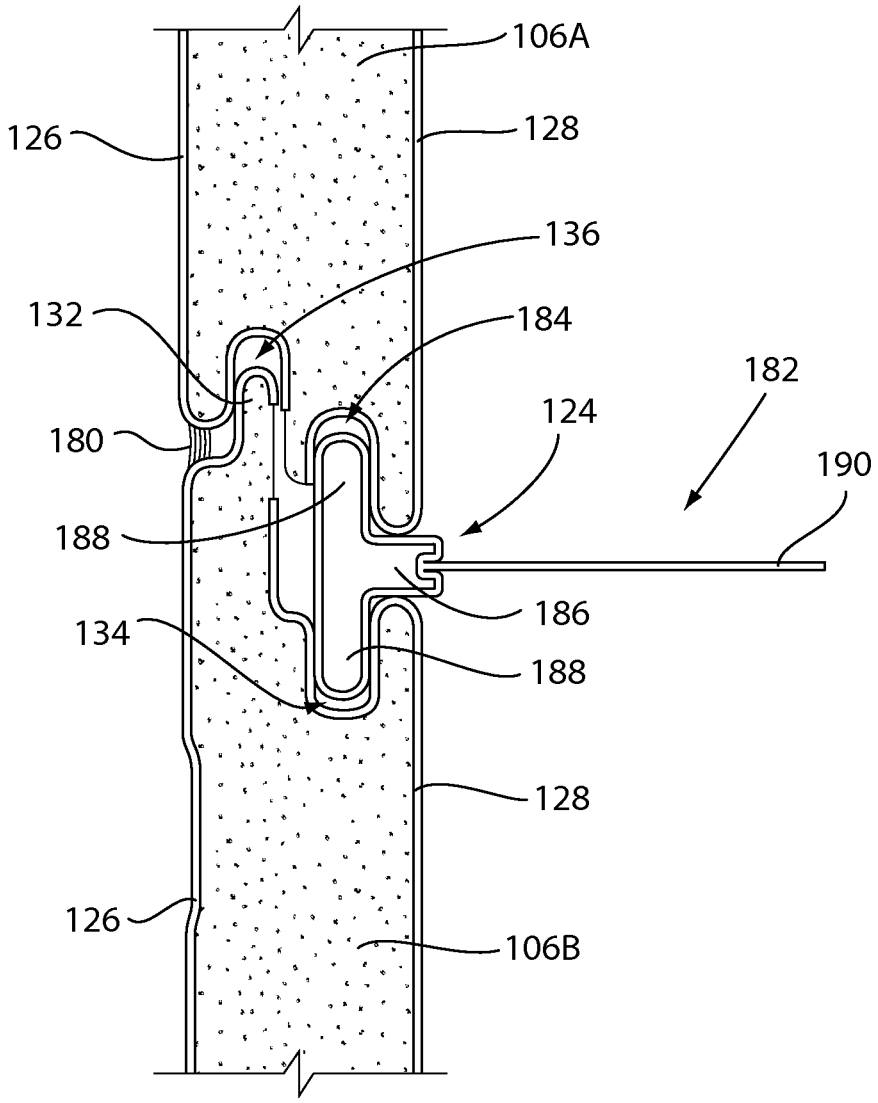
FIG. 11 illustrates connection of an alternate embodiment of a brick tie-in at an exemplary horizontal joint between top and bottom barrier panels for attachment of a brick exterior facade to the barrier panels (in the embodiment where the system is rotated 90°, the illustrated horizontal joint becomes a vertical joint)

FIG. 11 illustrates an alternate embodiment of a brick tie, shown generally at 182, for implementation with the present invention. In order for attachment of the brick tie 182 at the horizontal joint 124, the male connector 138 of the barrier panel 106A is replaced with a female connector 184, as shown in FIG. 11. The brick tie 182 includes a body portion 186 having opposing arms 188 which are received in the female connectors 184 and 134 of the barrier panels 106A and 106B, respectively, thus securing the brick tie 182 to the panels 106A, 106B. An outwardly extending portion 190 extends from the body portion 186 and attaches to the brick exterior (not shown). As previously noted, since bricks will typically rest on the ground, the brick tie 182 arrangement is designed for lateral support, rather than longitudinal support, of the bricks, which is typically not needed. While not shown in FIG. 11, sealant may be provided in the female connectors 134, 136 and 184, as well as at the horizontal joint 124.

Figure 12:
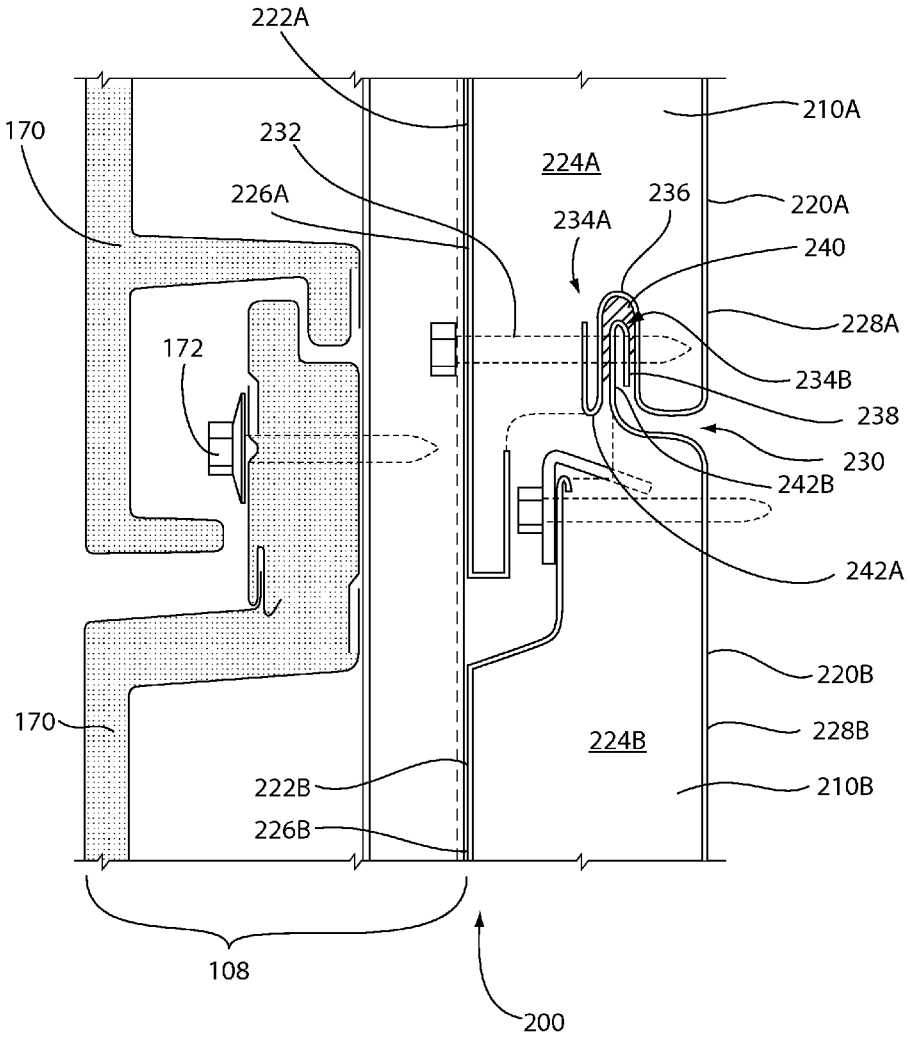
FIG. 12 illustrates a building wall system according to one embodiment of the present invention.

Referring to FIG. 12, a further embodiment of a building wall system 200 is disclosed. The building wall system 200 includes first and second barrier panels 210A, 210B and an exterior facade system 108. The exterior facade system 108 is similar to the facade system described above in connection with FIG. 9 and like reference numerals will be used to describe like components. Each panel 210A, 210B includes an inner sheet 220A, 220B and an outer sheet 222A, 222B with a foam core 224A, 224B positioned between the inner 220A, 220B and outer sheets 222A, 222B as described above in connection with panel 106. The inner 220A, 220B and outer sheets 222A, 222B of the first 210A and second 210B barrier panels define an inner surface 226A, 226B and an outer surface 228A, 228B, respectively. A joint 230 is defined by the first and second barrier panels 210A, 210B. In particular, as shown in FIG. 12, the first and second barrier panels 210A, 210B are adjoined to define a horizontal joint 230. The exterior facade system 108 is secured to the first and second barrier panels 210A, 210B via a fastener 232, such as a screw, that extends through the outer and inner sheets 222A, 220A of the first barrier panel 210A and the inner sheet 220B of the second barrier panel 210B without penetrating the inner surfaces 226A, 226B of the first and second barrier panels 210A, 210B. More specifically, the subframe 160 is attached to the first and second barrier panels 210A, 210B via the fastener 232 as described above and the exterior panels 170 are attached to the subframe 160 via fasteners 172.

The inner sheets 220A, 220B of the first and second barrier panels 210A, 210B each include an end portion 234A, 234B. When the first and second barrier panels 210A, 210B are adjoined, the end portions 234A, 234B are positioned adjacent to each other at the joint 230 with the fastener 232 extending through the inner sheets 220A, 220B of the first and second barrier panels 210A, 210B at a position adjacent to the end portions 234A, 234B. The end portion 234A of the inner sheet 220A of the first barrier panel 210A defines a female connector 236 and the end portion 234B of the inner sheet 220B of the second barrier panel 210B defines a male connector 238 with the female connector 236 receiving the male connector 238. The end portions 234A, 234B overlap in a direction that extends perpendicularly from the outer surfaces 228A, 228B. Sealant 240 is positioned within the female connector 236 between the end portions 234A, 234B of the inner sheets 220A, 220B of the first and second barrier panels 210A, 210B. As shown in FIG. 12, the end portions 234A, 234B of the inner sheets 220A, 220B of the first and second barrier panels 210A, 210B and the respective female and male connectors 236, 238 are positioned between the inner and outer surfaces 226A, 226B, 228A, 228B. Further, each of the end portions 234A, 234B include an overlapped section 242A, 242B of the respective inner sheets 220A, 220B with the fastener 232 extending through the overlapped sections 242A, 242B. Attaching the fastener 234 for the subframe to the inner sheets 220A, 220B reduces the likelihood of delamination of the outer sheets 222A, 222B from the core material 224A, 224B and increases the pullout capacity. In particular, the pullout capacity is increased when fastening between clips or between attachments to the building frame.

The wall framing 102 may be pre-attached to the barrier panels 106 before installation. The wall framing 102 may be pre-attached to one or more barrier panels 106, and then installed in large sections at the building site, rather than installing the wall framing 102 and then the panels 106 separately, typically installing the panels 106 one at a time. In this manner, the necessary wall framing 102 required for a particular application will be designed and attached to the panels 106. Then the panels 106, with attached wall framing 102, are attached to the building structure via conventional connection means. Through such panelization of the system, the building process is accelerated which, in turn, may have significant impact on temporary heat requirements and the minimization of moisture intrusion into the building interior during the construction process.

While the present invention has been described with particular reference to the drawings, it should be understood that various modifications could be made without departing from the spirit and scope of the present invention. For instance, while the barrier panels 106 are shown and described as being connected to the wall framing 102 at their upper side edges 120, the panels 106 may be rotated 180° such that the upper side edge 120 becomes the lower side edge, and the panels 106 connected to the wall framing 102 at that lower side edge without departing from the spirit and scope of the present invention. This orientation has a particular advantage in that water and/or other debris are less likely to enter and be retained in the female connector 134 (see FIG. 10) should the seal 180 be compromised, since in this orientation the female connector 134 would be orientated with the top panel 106 of the joint 124. In this orientation, as well as the orientation described below, the brick tie connector 174 would typically remain the same.

Additionally, the entire system may be rotated 90° such that the horizontal joint 124 described above becomes the vertical joint, and the vertical joint 118 becomes the horizontal 12 joint of the building system without departing from the spirit and scope of the present invention. A detailed discussion of this embodiment is not necessary, since the structure and attachment of the panels 106 remains the same, just rotated 90° so that the described horizontal joints become the vertical joints and the described vertical joints become the horizontal joints. In this embodiment, the exterior facade system 108 (subframe 160 and panels 170) will typically be attached to the panels 106 at their vertical joint for strength purposes, in the preferred manner as previously described. However, the panels 106 provide structural support for the exterior facade system 108 such that the exterior facade system 108 may be attached to the panels 106 at any portion thereof.

The invention claimed is:

1. A building wall system comprising:

first and second barrier panels, each panel comprising an inner sheet and an outer sheet with a foam core positioned between the inner and outer sheets, each of the first and second barrier panels defining an innermost surface and an outermost surface, the outermost surfaces of the first and second barrier panels defined by a portion of the respective outer sheets, the innermost surfaces of the first and second barrier panels defined by a portion of the respective inner sheets, and the inner sheet of the second barrier panel spaced from a portion of the outer sheet of the second barrier panel that defines the outermost surface; and an exterior façade system comprising a subframe and at least one exterior panel, wherein a joint is defined by the first and second barrier panels, the subframe engages at least one of the outer sheets of the first and second barrier panels and is secured to the first and second barrier panels via a fastener extending through the outermost surface of the first barrier panel, the outer and inner sheets of the first barrier panel, and the inner sheet of the second barrier panel without penetrating the innermost surfaces of the first and second barrier panels.

2. The building wall system of claim 1, wherein the inner sheets of the first and second barrier panels each include an end portion, the end portions being positioned adjacent each other at the joint, the fastener extending through the inner sheets of the first and second barrier panels at a position adjacent to the end portions.

3. The building wall system of claim 2, wherein the end portion of the inner sheet of the first barrier panel defines a female connector and the end portion of the inner sheet of the second barrier panel defines a male connector, the female connector receiving the male connector.

4. The building wall system of claim 2, wherein the end portions overlap in a direction that extends perpendicularly from the outermost surfaces.

5. The building wall system of claim 2, wherein sealant is positioned between the end portions of the inner sheets of the first and second barrier panels.

6. The building wall system of claim 3, wherein sealant is positioned within the female connector.

7. The building wall system of claim 2, wherein the end portions of the inner sheets of the first and second barrier panels are positioned between the innermost and outermost surfaces.

8. The building wall system of claim 3, wherein the female connector and the male connector are positioned between the innermost and outermost surfaces.

9. The building wall system of claim 1, wherein the inner and outer sheets comprise galvanized steel or aluminum.

10. The building wall system of claim 1, wherein the foam core of the first and second barrier panels comprises a foam material selected from the group consisting of polyurethane, poly-isocyanurate, phenolic foam, and mineral wool.

11. The building wall system of claim 1, wherein the outermost surface of the first and second barrier panels is striated or planked.

12. The building wall system of claim 1, wherein the inner sheets of the first and second barrier panels each include an end portion, the end portions being positioned adjacent each other at the joint, each of the end portions comprising an overlapped section of the respective inner sheets, the fastener extending through the inner sheets of the first and second barrier panels at a position adjacent to the end portions.

13. The building wall system of claim 12, wherein the end portion of the inner sheet of the first barrier panel defines a female connection and the end portion of the inner sheet of the second barrier panel defines a male connection, the female connection receiving the male connection.

14. The building wall system of claim 12, wherein the end portions overlap in a direction that extends perpendicularly from the outermost surfaces.

15. The building wall system of claim 12, wherein sealant is positioned between the end portion of the inner sheets of the first and second barrier panels.

16. The building wall system of claim 13, wherein sealant is positioned within the female connector.

17. The building wall system of claim 12, wherein the end portion of the inner sheets of the first and second barrier panels are positioned between the innermost and outermost surfaces.

18. The building wall system of claim 13, wherein the female connector and the male connector are positioned between the innermost and outermost surfaces.

19. A building wall system comprising:

first and second barrier panels, each panel comprising an inner sheet and an outer sheet with a foam core positioned between the inner and outer sheets, each of the first and second barrier panels defining an innermost surface and an outermost surface, the outermost surfaces of the first and second barrier panels defined by a portion of the respective outer sheets, the innermost surfaces of the first and second barrier panels defined by a portion of the respective inner sheets, and the inner sheet of the second barrier panel spaced from a portion of the outer sheet of the second barrier panel that defines the outermost surface; and an exterior façade system comprising a subframe, wherein a joint is defined by the first and second barrier panels when the first and second barrier panels are joined to each other, the subframe is secured to the first and second barrier panels via a fastener that extends through the subframe, through the outermost surface of the first barrier panel, the outer and inner sheets of the first barrier panel, and the inner sheet of the second barrier panel without penetrating the innermost surfaces of the first and second barrier panels.

20. The building wall system of claim 19, further comprising a panel clip, wherein the joint defines a space between the first and second barrier panels with a portion of the panel clip positioned in the space.

* * * * *